US011002050B1

(12) United States Patent
Wolthuis et al.

(10) Patent No.: US 11,002,050 B1
(45) Date of Patent: May 11, 2021

(54) RADIAL PROGRESSION HINGE CAP FOR A LIGATURE RESISTANT DOOR HINGE ASSEMBLY

(71) Applicant: Select Products Limited, Portage, MI (US)

(72) Inventors: Nathan Wolthuis, Vicksburg, MI (US); Daryl R. Johnson, Vicksburg, MI (US)

( * ) Notice: Subject to any disclaimer, the term of this patent is extended or adjusted under 35 U.S.C. 154(b) by 0 days.

(21) Appl. No.: 16/733,971

(22) Filed: Jan. 3, 2020

(51) Int. Cl.
*E05D 11/00* (2006.01)
*E05D 1/00* (2006.01)
*E05D 7/00* (2006.01)

(52) U.S. Cl.
CPC ..... *E05D 11/0054* (2013.01); *E05D 1/00* (2013.01); *E05D 7/009* (2013.01); *E05D 2011/0072* (2013.01); *E05Y 2900/132* (2013.01)

(58) Field of Classification Search
CPC ..... E05D 11/0054; E05D 2011/0063; E05D 2011/0072; E05D 3/122; E05D 1/00; E05D 7/009; E05C 17/54; E05Y 2900/132; Y10T 16/533; Y10T 16/5335
See application file for complete search history.

(56) References Cited

U.S. PATENT DOCUMENTS

| | | | | |
|---|---|---|---|---|
| 158,237 A | | 12/1874 | Blake | |
| 310,637 A | | 1/1885 | Barnekow | |
| 2,047,909 A | | 7/1936 | North | |
| 2,585,836 A | | 2/1952 | Quigley | |
| 3,206,792 A | | 9/1965 | Beck | |
| 3,229,323 A | | 1/1966 | Hensgen | |
| 3,252,179 A | | 5/1966 | Watson | |
| 3,431,590 A | | 3/1969 | Anderson | |
| 4,240,225 A | | 12/1980 | Sartain | |
| 4,411,045 A | | 10/1983 | Rock et al. | |
| 4,643,318 A | * | 2/1987 | Kopp | A47K 17/022 211/105.1 |
| 4,713,922 A | | 12/1987 | Ingold | |
| 4,988,083 A | * | 1/1991 | Bradley | B65D 81/056 114/219 |
| 5,680,675 A | | 10/1997 | Davis | |
| 5,911,264 A | | 6/1999 | Smrke et al. | |

(Continued)

FOREIGN PATENT DOCUMENTS

GB 2528545 B * 9/2017 ..... E05D 11/0054

OTHER PUBLICATIONS

Photograph that is representative of an angle-cut tip for a continuous geared hinge that was publicly used or on sale more than one (1) year prior to thefiling date of U.S. Appl. No. 61/231,249, filed Aug. 4, 2009.

*Primary Examiner* — Chuck Y Mah

(57) ABSTRACT

A radial progression hinge cap has a cap body that is configured to attach to a door jamb of a door frame above a geared continuous hinge that supports a door in the door frame. The cap body has a rear attachment channel that is configured to be attached at the door jamb. The cap body also has an upper surface that slopes downward from a top edge of the rear attachment channel to a front distal edge of the cap body. The front distal edge protrudes a threshold distance away from the rear attachment channel so that the upper surface of the cap body spans over and conceals a top surface of the geared continuous hinge and an upper corner of the edge portion of the door as it moves between the open and closed positions.

20 Claims, 9 Drawing Sheets

(56) References Cited

U.S. PATENT DOCUMENTS

D486,920 S * 2/2004 Hein ..... E05C 19/161 D25/102
6,735,821 B1 5/2004 Christman, Jr.
D549,844 S * 8/2007 Beard, Jr. ..... E04F 11/1802 D25/102
D549,846 S * 8/2007 Beard, Jr. ..... E03C 1/04 D25/102
D575,412 S * 8/2008 Beard, Jr. ..... D25/102
7,536,747 B2 5/2009 Christeson et al.
7,650,670 B2 1/2010 Baer et al.
7,774,902 B2 * 8/2010 Whyzel ..... A47K 17/022 16/436
D643,546 S * 8/2011 Ringus ..... E06B 7/362 D25/133
8,312,596 B2 11/2012 Self
D676,624 S * 2/2013 Wright ..... E04F 21/22 D34/27
8,505,880 B2 8/2013 Langenwalter
8,646,151 B2 * 2/2014 Kopp ..... E04F 11/1802 16/110.1
D719,010 S 12/2014 Russo et al.
8,898,861 B2 12/2014 Schau
9,328,546 B1 * 5/2016 Davis ..... E06B 7/362
RE46,240 E 12/2016 Schau
D844,426 S * 4/2019 Mueller ..... E04H 17/063 D8/403
10,385,598 B2 8/2019 Shah et al.
2004/0154129 A1 8/2004 Martinez-Munoz
2007/0261201 A1 11/2007 Baer et al.
2008/0053004 A1 3/2008 Oberoi
2010/0200823 A1 * 8/2010 Ringus ..... E04H 17/063 256/1
2011/0315245 A1 * 12/2011 Neagoe ..... E03C 1/04 137/560
2013/0019434 A1 1/2013 Kopp et al.
2017/0145702 A1 * 5/2017 Ceysson ..... F16M 11/38
2018/0220799 A1 * 8/2018 Mueller ..... F16M 11/38
2018/0325326 A1 * 11/2018 Hall ..... E05C 19/161

* cited by examiner

RADIAL PROGRESSION HINGE CAP FOR A LIGATURE RESISTANT DOOR HINGE ASSEMBLY

TECHNICAL FIELD

This disclosure relates generally to ligature resistant door, and more particularly relates to geared continuous hinges and associated devices for preventing misuse of the top surface thereof.

BACKGROUND

It is generally known that hinges can be used for purposes other than facilitating the opening and closing of a supported door, such as for the hanging of objects or other uses that may be destructive or damaging to the hinge and door. In addition to misuses of a hinge that can lead to damage to the hinge and door, such as unhinging the door from the door frame, other misuse of the hinge can result in injury to those misusing the hinge. For example, there is a heightened risk at institutions like prisons and mental hospitals of people hanging or injuring themselves from the protruding top surfaces of a hinge. Accordingly, it is desired to design areas in these facilities to be ligature resistant and deter self-inflicted injury.

SUMMARY

The present disclosure provides a radial progression hinge cap and corresponding ligature resistant hinge assembly that may be used to movably support a door, while covering an upper corner of the door nearest the hinge and an exposed top surface of the hinge, such as a geared continuous hinge, as the door moves between various positions. Such a radial progression hinge cap thereby prevents the misuse of the door's upper corner or exposed top surface of the hinge at various radial positions of the door, such as to prevent the hanging of objects or other abusive or destructive uses. The radial progression hinge cap may be mounted to a vertical support, such as a door jamb, directly above the hinge. The hinge cap may have a rear attachment channel, which may be vertically oriented and attached at a corner of the door jamb. A front portion of the cap body may have an upper surface that slopes downward from a top edge of the attachment channel to a lower edge of the front portion that is configured to extend over the top surface of the hinge and the upper corner of the door. The upper surface may flare outward as it slops downward from the top edge to an arcuate shaped lower edge, such as to form a conical surface that spans over and conceals a top surface of the hinge and the upper corner of the door as it moves between the open and closed positions.

According to one aspect of the present disclosure, a radial progression hinge cap has a cap body that is configured to attach to a door jamb of a door frame above a geared continuous hinge that supports a door in the door frame. The cap body has a rear channel with a first planar surface and a second planar surface oriented perpendicular relative to each other. The first planar surface is configured to be attached at an inner vertical surface of the door jamb that faces an edge portion of the door in a closed position. The second planar surface is configured to be attached at an outer vertical surface of the door jamb that is generally parallel with a planar extent of the door in the closed position. The cap body also has an upper surface that slopes downward from a top edge of the first and second planar surfaces of the rear channel to a front distal edge of the cap body. The front distal edge protrudes a threshold distance away from the rear channel so that the upper surface of the cap body spans over and conceals a top surface of the geared continuous hinge and an upper corner of the edge portion of the door as it moves between the closed position and an open position, such as being pivoted about the geared continuous hinge at least 90 degrees from the closed position.

According to another aspect of the present disclosure, a radial progression hinge cap includes a cap body that is configured to attach to a door jamb above a hinge that supports a door. The cap body has a rear portion that includes an attachment channel configured to be vertically oriented and attached at a corner of the door jamb. A front portion of the cap body has an upper surface that slopes downward from a top edge of the attachment channel to a lower edge of the front portion that is configured to extend over a top surface of the hinge and an upper corner of the door. The upper surface of the cap body includes two sloped portions at the opposing lateral edges of the upper surface that each angle downward from the top edge of the attachment channel to the lower edge of the front portion. The upper surface also has a transitional sloped portion that interconnects the two sloped portions at the opposing lateral edges of the upper surface to form a conical surface.

According to a further aspect of the present disclosure, a ligature resistant hinge assembly includes a geared continuous hinge having a frame leaf in meshed engagement with a door leaf and a cover holding meshed gear sections of the frame leaf and door leaf together along a length of the geared continuous hinge. The frame leaf is configured to be mounted at a door jamb and the door leaf is configured to be mounted to a door that is movable between open and closed positions about the geared continuous hinge. The hinge assembly also includes a radial progression hinge cap that is configured to attach to the door jamb above the geared continuous hinge. The radial progression hinge cap includes a rear channel that has a first planar surface and a second planar surface oriented perpendicular relative to each other. The first planar surface is configured to be attached at an inner vertical surface of the door jamb that faces an edge portion of the door in a closed position. The second planar surface is configured to be attached at an outer vertical surface of the door jamb that is generally parallel with a planar extent of the door in the closed position. The hinge cap also includes an upper surface that slopes downward from a top edge of the first and second planar surfaces of the rear channel to a front distal edge of the radial progression hinge cap. The upper surface protrudes from the rear channel a threshold distance that extends over and conceals a top surface of the geared continuous hinge and an upper corner of the door as it moves between the open and closed positions.

To securely mount the hinge cap at the respective doorjamb, a fastener may be provided that has a head portion and a shank portion that is configured to extend through a countersunk hole in the upper surface of the radial progression hinge cap to mount the radial progression hinge cap at the door jamb. Further, the head portion of the fastener may be disposed in a head section of the countersunk hole, so as to prevent misuse of the fastener, such as hanging objects from the head portion of the fastener.

These and other objects, advantages, purposes, and features of the present disclosure will become apparent upon review of the following specification in conjunction with the drawings.

DETAILED DESCRIPTION

Figure 1:
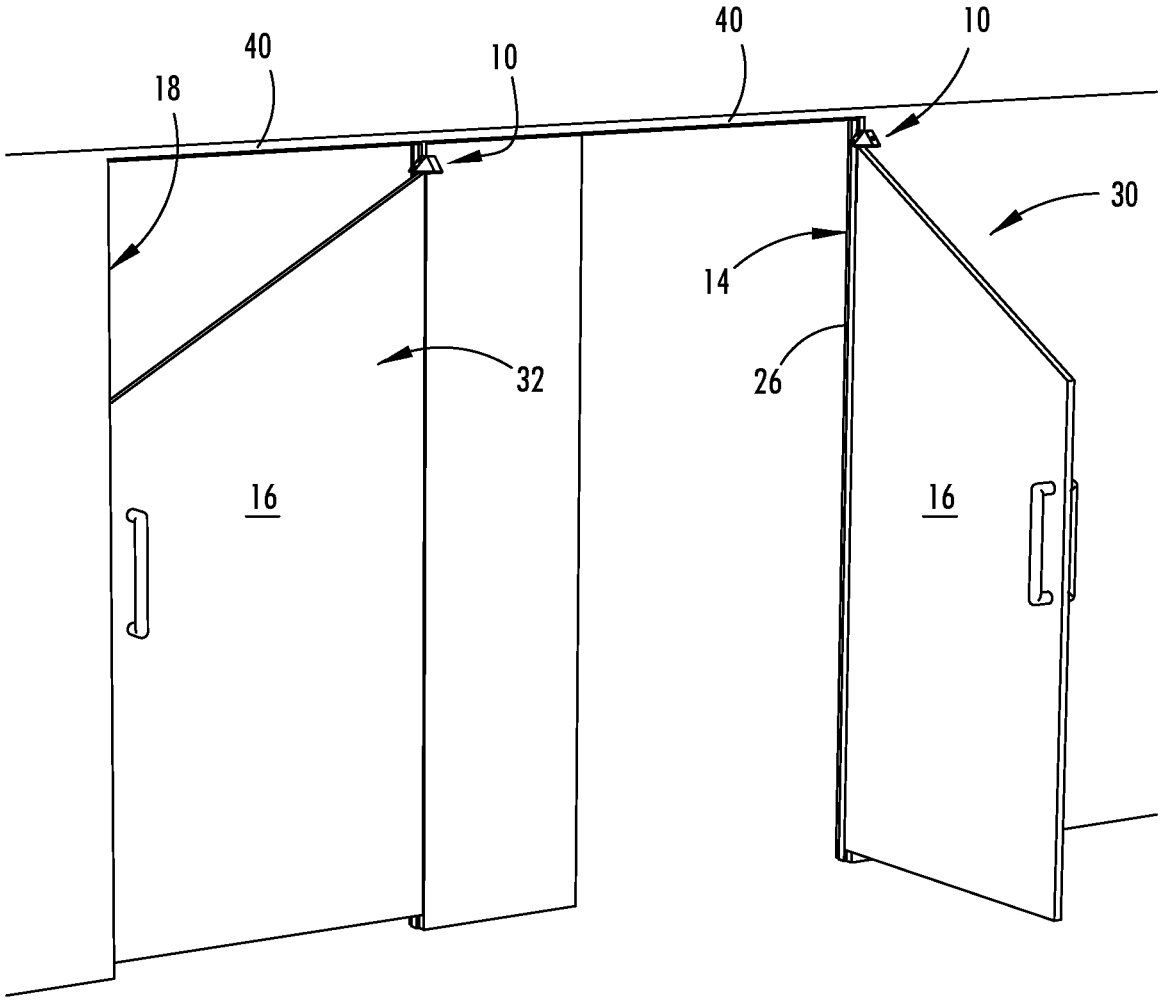
FIG. 1 is a perspective view of two doors with ligature resistant hinge assemblies that each provide a radial progression hinge cap mounted above a geared continuous hinge.

Referring now to the drawings and the illustrative embodiments depicted therein, a radial progression hinge cap 10 is provided for covering or overhanging a top surface 12 of a door hinge, such as a geared continuous hinge 14, which may movably support a door 16 as it swings about the hinge 14 between various radial positions. As shown in FIG. 1, an upper edge of the door 16 may be angled downward away from the hinge 14 to prevent misuse of the upper edge of the door 16. However, such a sloped angle to the upper edge of the door 16 creates a sharp corner nearest the hinge 14. The radial progression hinge cap 10 may be mounted to a vertical door support, such as a door jamb directly above the hinge 14, so as to cover an upper corner of the door 16 nearest the hinge 14, the exposed top surface 12 of the hinge 14, and any gap there between. Moreover, the radial progression hinge cap 10 provides continuous coverage of such exposed surfaces, door corner, and gap as the door 16 moves between the various radial positions, such as between the open and closed positions 30, 32 shown in FIG. 1. Covering the top surface 12 of the geared continuous hinge 14 and these other exposed areas may prevent misuse thereof, such as the hanging of objects or ligatures, using the sharp edges for abusive or destructive purposes, or attempting to pry the hinge or door away from the door frame 18. The radial progression hinge cap 10 is particularly useful for covering a geared continuous hinge that is mounted in a doorway that does not have a header or has a header that is spaced from the top of the hinge and the door, such as, for example, a doorway that may be of the type used in a bathroom stall, a changing area, or a privacy enclosure of a correctional institution.

Figure 2:
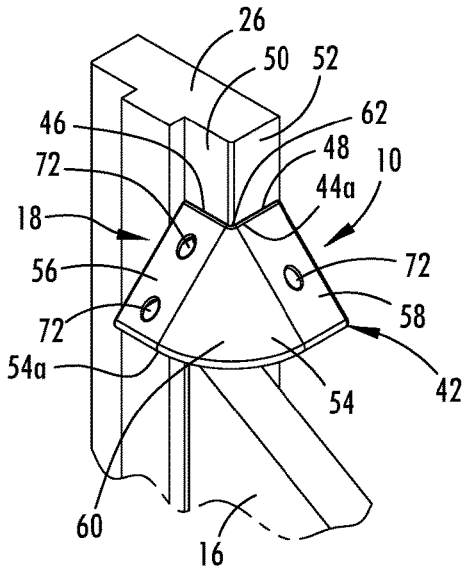
FIG. 2 is an upper perspective view of a radial progression hinge cap mounted at a door jamb above the door shown in FIG. 1 that is in an open position.
Figure 2A:
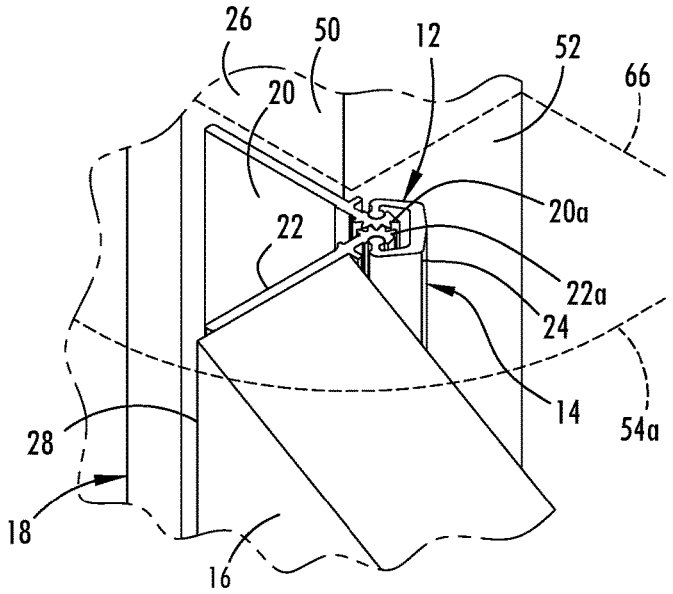
FIG. 2A is an enlarged view of the door and the door jamb shown in FIG. 2 with the radial progression hinge cap removed to expose a geared continuous hinge.

A geared continuous hinge 14 generally has a frame leaf 20 in meshed engagement with a door leaf 22 and a cover 24 that holds meshed gear sections 20*a*, 22*a* of the frame leaf 20 and door leaf 22 together along a length of the geared continuous hinge 14, such as shown in FIG. 2A. The cover 24 is held in place relative to the frame and door leaves 20, 22 with bearing blocks that are secured in slots located intermittently along the length of the hinge 14, where such slots may be formed horizontally in the gear sections of the hinge. When installed, the exposed top surface of the geared continuous hinge 14 typically includes a flat top surface of the door leaf, the frame leaf, and the cover, which can have sharp edges around the horizontal supportive areas. The radial progression hinge cap 10 can be utilized to cover and conceal such edges and areas of these top surfaces.

There are essentially three types of geared continuous hinges: a mortise type hinge (FIGS. 2-8C), and a full surface type hinge (FIGS. 6-15C). A full surface type hinge refers to both of the hinge leafs (i.e., the door leaf and frame leaf) being installed at the outer surface of the door and the vertical door support (i.e., the door jamb), such that both hinge leafs may be exposed after installation of the hinge to the door and door support with the door in the close position 32. The mortise type hinge refers to at least one of the hinge leafs being mortised or recessed between the edge of the door and the inner surface of the door support (i.e. the door jamb). As shown in FIGS. 2-5C, a full mortise has both hinge leafs being mortised or recessed, and as shown in FIGS. 5-8C, a half mortise has one of the hinge leafs mortised or recessed. Thus, the radial progression hinge cap may be utilized with each type of geared continuous hinges, including those illustrated herein and other configurations.

When the geared continuous hinge 14 is installed at a door frame 18, such as when retro-fitting an existing doorway with a geared continuous hinge, the frame leaf 20 is attached to a vertical member 26 of the door frame 18, which may also be referred to as the door jamb, the side jamb, or the hinge jamb. The door leaf 22 of the geared continuous hinge 14 is attached along the vertical edge portion 28 of the door 16 for the door 16 to be operable to pivot about the geared continuous hinge 14 between the open and closed positions 30, 32 (FIG. 1). In the closed position 32, such as shown to the left in FIG. 1, the door 16 is seated or positioned in the opening of the door frame 18. In the open position 30, such as shown to the right in FIG. 1, the door 16 is pivoted out of the opening of the door frame 18 and away from the lock jamb on the opposing side of the door frame 18 from the door jamb 26. The attachment of the frame leaf 20 and door leaf 22 of the geared continuous hinge 14 is provided with fasteners 35 (FIG. 3), such as screws, security screws, or rivets, but may also or alternatively employ adhesive or welding to provide a secure installation.

The exposed top surface 12 of the geared continuous hinge 14 typically includes a flat upper surface of the frame leaf 20, the door leaf 22, and the cover 24, which can have a sharp outer edge 38 and several supportive areas. The exposed top surface 12 is not an entire continuous planar surface since there are substantial openings in the surface, such as formed by the spacing between the gear sections 20*a*, 22*a* and the cover 24 and the spacing between the fastener cover 34. As shown in FIG. 6A, the exposed top surface 12 also includes the flat upper surface of the fastener cover 34 of the door leaf 22, where each of the flat upper surfaces that constitute the exposed top surface 12 are generally horizontal and in alignment with each other about a common horizontal plane. As further shown in FIG. 1, the mounting location of the radial progression hinge cap 10 below the header 40 of the door frame 18 allows the radial progression hinge cap 10 and geared continuous hinge 14 to be installed at doorways that do not have a header or otherwise have a header that is located or designed at a distance away from the door that is unsuitable for providing a hinge cap at the header.

As shown in FIG. 2, the radial progression hinge cap 10 includes a cap body 42 that is configured to attach to a vertical door support, such as a door jamb 26, above a hinge that supports a door to conceal the top surface of the hinge and the upper corner of the door nearest the hinge with the door in multiple positions. The cap body 42 may attach to a door jamb 26 of a door frame 18 in various manners immediately above the top surface 12 of the hinge 14. As shown in FIG. 2, a rear portion of the cap body 42 may be secured to the vertical door support in a manner that securely supports the cap body 42 over the exposed top surface 12 of the geared continuous hinge 14, which is shown as a mortise type hinge.

Figure 3:
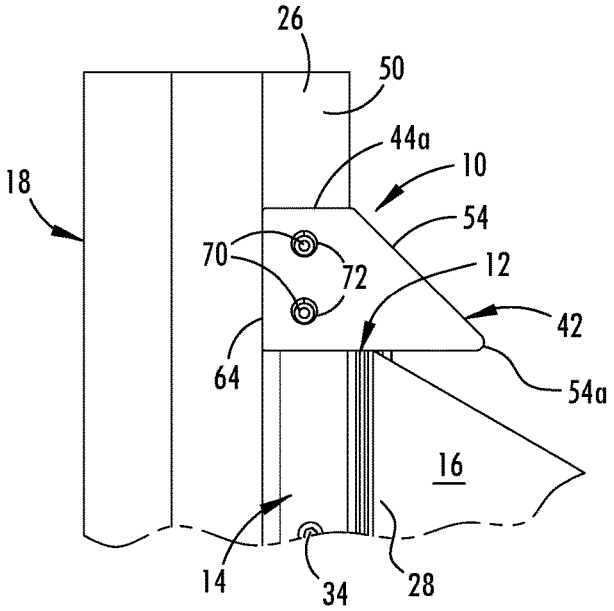
FIG. 3 is a side elevational view of the radial progression hinge cap mount at the door jamb above the door shown in FIG. 2.
Figure 4:
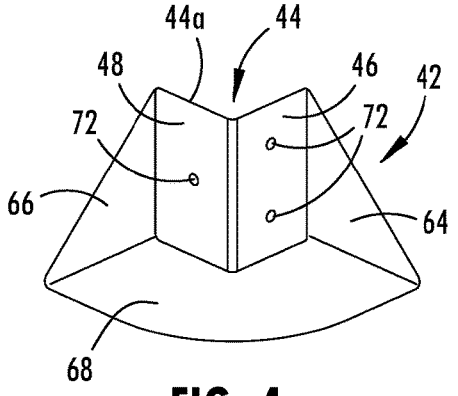
FIG. 4 is a rear perspective view of the radial progression hinge cap shown in FIG. 2.
Figure 5A:
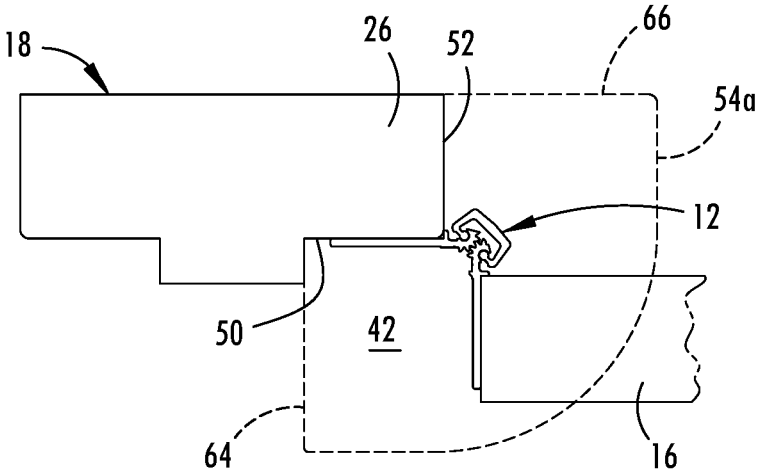
FIG. 5A is a top view of the geared continuous hinge supporting the door at the door jamb shown in FIG. 2, showing an outline of the radial progression hinge cap in dashed lines.
Figure 5B:
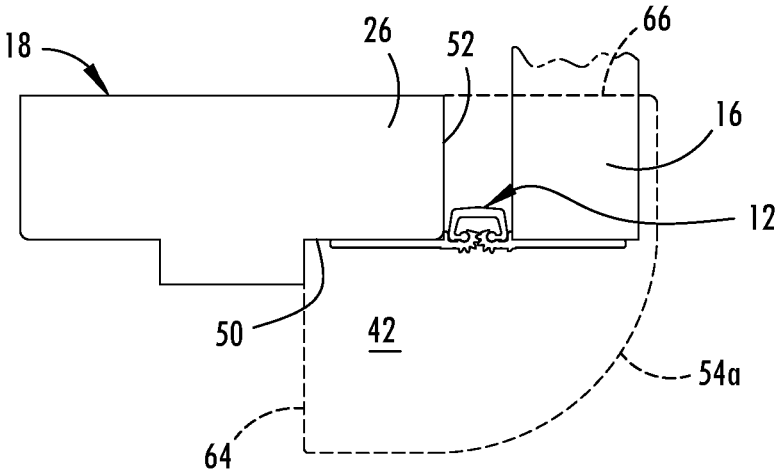
FIG. 5B is a top view of the outline of the radial progression hinge cap and the geared continuous hinge shown in FIG. 5A, showing the door at another open position.
Figure 5C:
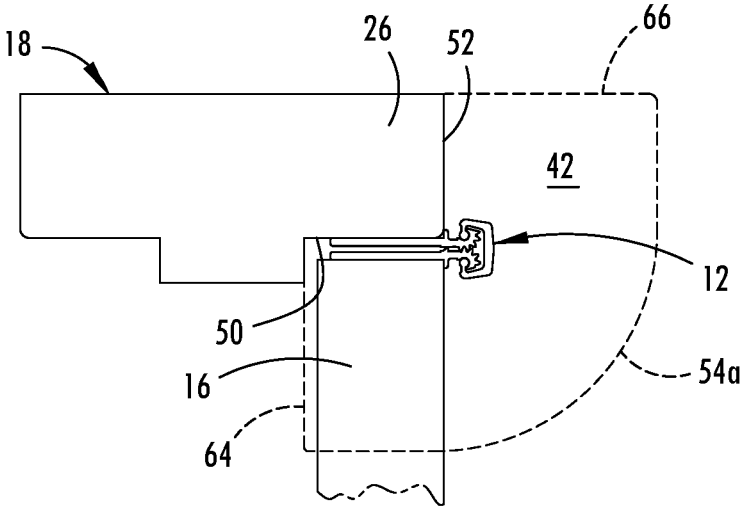
FIG. 5C is a top view of the outline of the radial progression hinge cap and the geared continuous hinge shown in FIG. 5A, showing the door at a closed position.

As further shown in FIGS. 2-4, the cap body 42 has a rear channel 44 that is attached to a corner portion of the door jamb 26. The rear channel 44 has a first planar surface 46 and a second planar surface 48 that are oriented perpendicular relative to each other, so as to mate with the orthogonal shape of the corner portion of the door jamb 26. In other implementations, the rear channel may have an alternative shape (e.g., a shape with the surfaces oriented at more or less of an angle) so as to mate with a differently shaped portion of a vertical door support. The first planar surface 46 is attached at an inner vertical surface 50 of the door jamb 26 that faces an edge portion of the door 16 in the closed position 32 (FIG. 5C). The second planar surface 48 is configured to be attached at an outer vertical surface 52 of the door jamb 26 that is generally parallel with a planar extent of the door 16 in the closed position 32. Accordingly, the rear portion of the cap body may be shaped to securely mate and attach to the corner portion of the door jamb or otherwise to a desired area of a vertical door support above the exposed top surface of the door hinge.

The cap body 42 also has an upper surface 54 that slopes downward from a top portion of the cap body 42, such as the top edge 44*a* of the rear channel 44, to provide a ligature-resistant surface on the radial progression hinge cap 10. The cap body 42 is configured for the upper surface 54 to directly contact the vertical surface of the door support (i.e., door jamb 26) to prevent to formation of any gaps or catch-points between the top portion of the cap body 42 and the door jamb 26. The upper surface 54 of the cap body 42 extends downward to and terminates at a front distal edge 54*a* of the cap body 42. The front distal edge 54*a* protrudes a threshold distance away from the engaged portion of the door jamb 26, so that the upper surface 54 of the cap body 42 spans over and conceals a top surface 12 of the geared continuous hinge 14. The threshold distance that the front distal edge 54*a* protrudes away from the engaged portion of the door jamb 26 (i.e., the rear channel 44) may also conceal the upper corner of the edge portion of the door 16 as it moves between the closed position 32 and an open position 30, such as being pivoted about the geared continuous hinge at least 90 degrees from the closed position 32, as shown in FIG. 5A. The upper surface 54 of the cap body 42 may also conceal the top surface of the hinge and upper corner of the door at additional radial positions, such as at any possible open position for the door and hinge combination, such as 180 degrees from the closed position as shown in FIG. 5B.

The upper surface 54 of the cap body 42 may flare outward as it slops downward from the top edge 44*a* of the rear channel 44 to provide the desired radial coverage of the door and hinge combination. As shown in FIG. 2, the upper surface 54 of the cap body 42 flares outward to have a partial conical shape with the narrow portion of the conical shape following the top edge 44*a* of the rear channel 44 and the widened portion of the conical shape following the front distal edge 54*a* of the cap body 42. Thus, the front distal edge 54*a* may have an at least partially arcuate shape. In alternative implementations, the upper surface of the cap body may slope downward in different shapes, such as in segmented planar sections or the like.

As further shown in FIG. 2, the upper surface 54 includes a first sloped portion 56, a second sloped portion 58, and a transitional sloped portion 60. The first sloped portion 56 angles downward from the top edge 44*a* of the first planar surface 46 to the front distal edge 54*a*. Similarly, the second sloped portion 58 angles downward from the top edge 44*a* of the second planar surface 48 to the front distal edge 54*a*. The first and second sloped portions 56, 58 of the upper surface 54 slope downward at a generally equal and constant angle. The transitional sloped portion 60 interconnects the first and second sloped portions 56, 58 and has an outward protruding curvature that defines a conical shaped surface. The transitional sloped portion 60, as shown in FIG. 2, angles downward from a corner 62 of the top edge 44*a* to the front distal edge 54*a* at generally the same angle as the first and second sloped portions 56, 58. The edges of the conical shaped surface of the transitional sloped portion 60 mate flush with and interconnects with the first and second sloped portions 56, 58 continuously from the top edge 44*a* to the front distal edge 54*a*. In doing so, the transitional sloped portion 60 aligns with the first and second sloped portions 56, 58 to provide the upper surface 54 with a smooth and obstruction-free contour. It is also understood that a transitional sloped portion in additional implementations of the cap body may similarly interconnect sloped portions with differing angles of downward slope, while still providing a smooth and aligned transition between such sloped portions.

The upper surface 54 that slopes downward from the top edge 44*a* that abuts the door jamb at an angle of approximately 45 degrees relative to the vertical plane of the door jamb 26. The angle of the upper surface 54, or portions thereof, may be larger or smaller than 45 degrees and may be generally greater than 25 degrees to provide a sloped upper surface that prevents objects from being supported on the top surface 12 of the hinge 14. Although the upper surfaces 46, 48 are shown as generally planar surfaces, it is contemplated that the upper surfaces may have a convex or concave curved shape while still providing the desired function of similarly covering the exposed top surface 12 of the hinge 14 and being generally incapable of supporting an object or harming oneself thereat.

As shown in FIG. 4, the lateral side surfaces 64, 66 of the cap body 42 are planar, vertically oriented, and arranged to be orthogonal relative to each other. These side surfaces 64, 66 may partially interface with portions of a door jamb (such as shown in FIG. 2) or other structures and may be exposed. As also shown in FIG. 4, a planar and horizontally oriented bottom surface 68 of the cap body 42, such as to be generally aligned with the exposed top surface 12 of the hinge 14. The bottoms surface 68 is bordered by the front distal edge 54*a*, the bottom edges of the lateral side surfaces 64, 66, and the bottom edge of the rear channel 44. In additional implementations, the bottom surface may alternatively have openings, such as when the cap body is cast or molded to have a hollow interior area. Similarly, other surface that are generally substantially exposed after installation, such as the rear channel surfaces, may have similar openings from casting or molding formation of a cap body.

As shown FIGS. 2A and 5A-5C, the border of the bottom surface 68 may generally define the coverage area of the cap body, where the front distal edge 54*a* protrudes a distance beyond the outermost tip of the door leaf 22, and thereby also cover the corresponding corner of the door 16. Such a coverage area of the radial progression hinge cap 10 provides continuous coverage and concealment of the exposed upper corner of the door 16 nearest the hinge 14 and the exposed top surface 12 of the hinge 14 as moves between the various radial positions, such as between the open position 30 at 90 degrees (FIG. 5A), the open position 30 at 180 degrees (FIG. 5B), and the closed position 32 (FIG. 5C).

To securely mount the cap body 42 at the doorjamb, the radial progression hinge cap 10 shown in FIGS. 2-4 has three fasteners 70, which each may have a shank portion and a head portion. The shank portion extends through one of the countersunk holes 72 in the cap body 42 to mount the cap body 42 at the doorjamb. The shank portion includes threads that engage the door jamb to securely mount the respective hinge cap. As shown in FIG. 3, the head portion of the fastener 70 may be at least partially disposed in an enlarged section or head section of the countersunk hole 72 to at least partially conceal the head portion, so as to prevent misuse of the fastener 70. The fastener 70 may be a security type screw, where the head portion is configured to require a special tool to tighten or remove the screw. The fastener 70 and countersunk hole 72 may together be configured for the head portion of the fastener 70 to be recessed far enough into the enlarged section or head section of the countersunk hole 72 on the front side of the hinge cap to avoid interfering with the downward sloping upper surface. As such, the enlarge section or head section of the countersunk hole 72 may have a shape, such as a conical shaped bottom or flat-shaped bottom, to accommodate the corresponding head portion of the fastener.

As shown in FIG. 2, the first sloped portion 56 of the upper surface 54 has two holes 72 that extend in parallel alignment with the lateral side surface 64 and pass through the first planar surface 46 of the rear channel 44. The holes 72 are arranged for receiving fasteners 70 that attach the cap body 42 to the door jamb. Specifically, the fasteners 72 that extend though the first sloped portion 56 extend through the inner vertical surface 50 of the door jamb 26 that faces an edge portion of the door 16 in the closed position 32. Also, the second sloped portion 58 of the upper surface 54 has a single hole 72 that extends in parallel alignment with the lateral side surface 66 and passes through the second planar surface 48 of the rear channel 44. The hole 72 is arranged for receiving a fastener 70 that attaches the cap body 42 to the door jamb in a manner that avoid contacting the perpendicularly extending fasteners 72 that pass through the first sloped portion 56. The fastener 72 that extends though the second sloped portion 58 extends through the outer vertical surface 52 of the door jamb 26 that is generally parallel with a planar extent of the door 16 in the closed position 32. More or fewer fasteners may be disposed in the respective portions of the cap body in additional implementations of the hinge cap to accommodate different dimensions or cap support needs.

The cap body 42 may be made from a rigid material that is hard and durable to minimize tampering or destruction of the cap and underlying hinge 14. The rigid material of the cap body 42 is provided at the upper surface 54 to prevent the formation of indentations thereat, and thus maintain a smooth sloped surface. Such a rigid material may be a rigid polymeric material or a metal, such as an aluminum or stainless steel alloy, but may also or alternatively comprise a thermoplastic composite material, ceramic, or fiberglass. The sloped upper surface 54 may also have a low friction finish to prevent frictional engagement of a hanging item, where such a low-friction finish may be provided by a surface finishing or a surface coating or the like.

Referring now to another example of a radial progression hinge cap 110 shown in FIGS. 6-8C, the hinge cap 110 includes a cap body 142 that attaches to a door jamb 126 above a geared continuous hinge 114 to conceal the top surface of the hinge and the upper corner of the door 116 nearest the hinge 114 with the door 116 in various positions. The cap body 142 is secured to the door jamb 126 so that the cap body 142 spans over the exposed top surface 112 of the geared continuous hinge 114, which is shown in FIGS. 6A and 8A-8C as a half-mortise type hinge. The half-mortise type hinge 114 shown in FIGS. 6-8C has the door leaf 122 attached at the outer surface of the door 116, while the frame leaf 120 is recessed or mortised in its attachment to the door jamb 126. When installed at the outer surface of the door 116, the door leaf 122 may have a fastener cover 135 that is secured vertically along an exterior side of the door leaf to conceal the fasteners used to mount the leaf at the door. For example, as shown in FIG. 6A, the fastener cover 135 is secured, such as via a snap-fit connection, over a base portion 136 of the door leaf 122 that is mounted against the door 116 and secured in place with fasteners that engage the door 116. The fastener cover in other implementations may also or alternatively include other fastening means, such as a concealed fastener (i.e., a covered screw or the like), to hold the fastener cover over the base portion of the respective leaf.

Figure 8A:
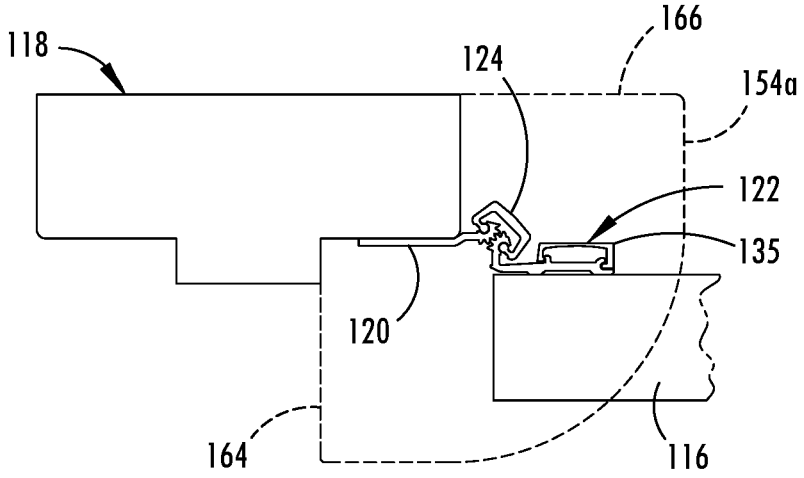
FIG. 8A is a top view of the geared continuous hinge supporting the door at the door jamb shown in FIG. 6, showing an outline of the radial progression hinge cap in dashed lines.
Figure 8B:
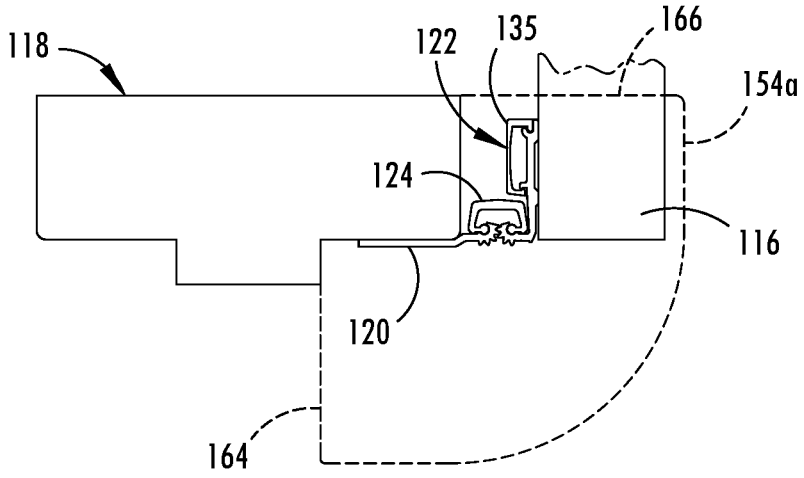
FIG. 8B is a top view of the outline of the radial progression hinge cap and the geared continuous hinge shown in FIG. 8A, showing the door at another open position.
Figure 8C:
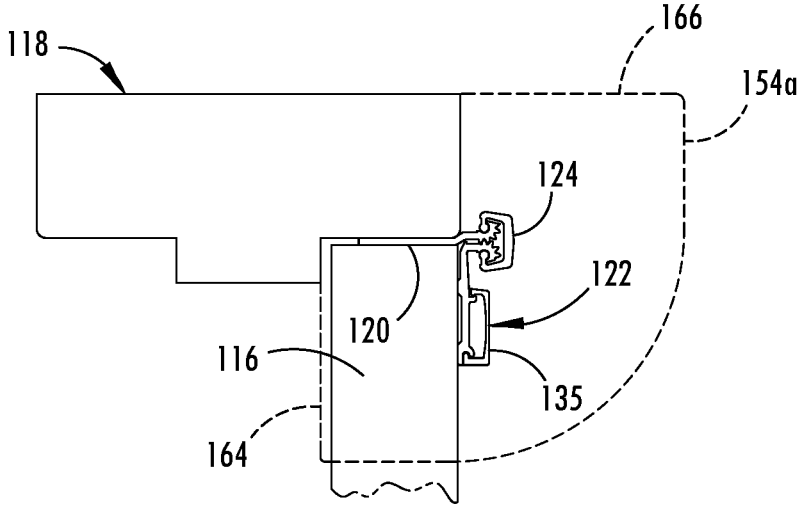
FIG. 8C is a top view of the outline of the radial progression hinge cap and the geared continuous hinge shown in FIG. 8A, showing the door at a closed position.

As shown FIGS. 6A and 8A-8C, the radial progression hinge cap 110 has an upper surface 154 that directly contacts the vertical surface of the door jamb 126 and slopes downward from the top edge 144*a* of the rear channel 144 to provide a ligature-resistant surface, generally without gaps or catch-points between the top of the cap body 142 and the door jamb 126. The upper surface 154 of the cap body 142 extends downward to and terminates at a front distal edge 154*a* of the cap body 142, where the front distal edge 154*a* protrudes a threshold distance away from the engaged portion of the door jamb 126. As shown in FIGS. 8A-8C, the upper surface 154 of the cap body 142 spans over and conceals a top surface 112 of the geared continuous hinge 114, including the door leaf 122 and the frame leaf 120, as well as the upper corner of the door 116 as it moves between the closed position 132 (FIG. 8C) and open positions 130 (FIGS. 8A and 8B). The illustrated border of the bottom surface 168 of the hinge cap shown in FIG. 6A may generally define the coverage area of the cap body 142, where the front distal edge 154*a* protrudes a distance beyond the outermost tip of the door leaf 122 and the corresponding corner of the door 116. Such a coverage area of the radial progression hinge cap 110 provides continuous coverage and concealment of the exposed upper corner of the door 116 nearest the hinge 114 and the exposed top surface 112 of the hinge 114 as moves between the various radial positions, such as between the open position 130 at 90 degrees (FIG. 8A), the open position 130 at 180 degrees (FIG. 8B), and the closed position 132 (FIG. 8C).

Figure 6:
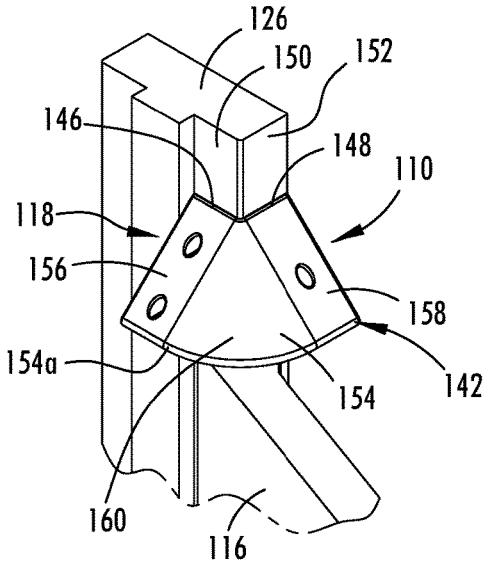
FIG. 6 is an upper perspective view of a radial progression hinge cap mounted at a door jamb above a door shown in an open position.
Figure 6A:
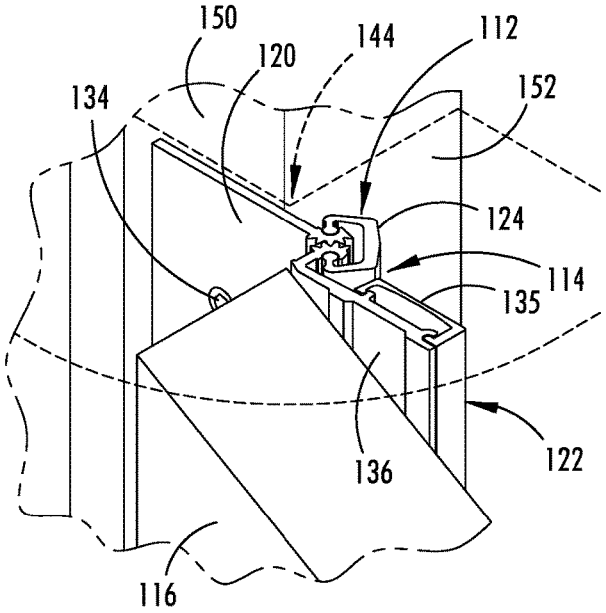
FIG. 6A is an enlarged view of the door and the door jamb shown in FIG. 6 with the radial progression hinge cap removed to expose a different geared continuous hinge from that shown in FIG. 2A.
Figure 7:
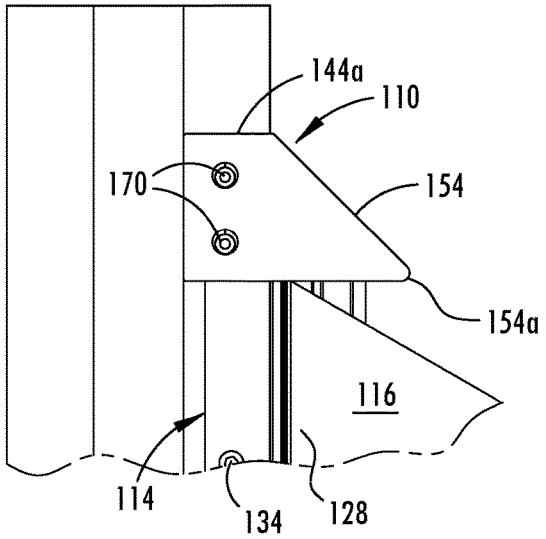
FIG. 7 is a side elevational view of the radial progression hinge cap mount at the door jamb above the door shown in FIG. 6.

As further shown in FIGS. 6 and 7, the cap body 142 has a rear channel 144 that is attached to a corner portion of the door jamb 126. The rear channel 144 has a first planar surface 146 and a second planar surface 148 that are oriented perpendicular relative to each other, so as to mate with the orthogonal shape of the corner portion of the door jamb 126. As further shown in FIG. 6, the upper surface 154 of the cap body 142 flares outward as it slops downward from the top edge 144*a* of the rear channel 144 to provide the desired radial coverage of the door and hinge combination. The upper surface 154 of the cap body 142 flares outward to have a partial conical shape with the front distal edge 156 having an arcuate shape.

Other features of the radial progression hinge cap 110 and associated geared continuous hinge 114 and doorway arrangement that are similar to the radial progression hinge cap 10 and associated geared continuous hinge 14 shown in FIGS. 2-4, and thus are not described in detail again, but like reference numbers are used incremented by 100.

Figure 9:
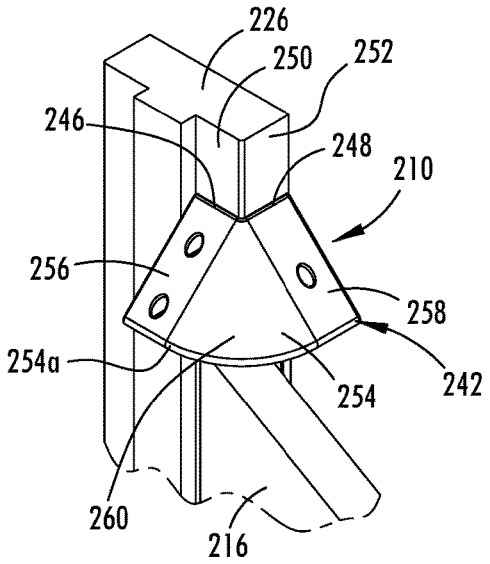
FIG. 9 is an upper perspective view of a radial progression hinge cap mounted at a door jamb above a door shown in an open position.
Figure 9A:
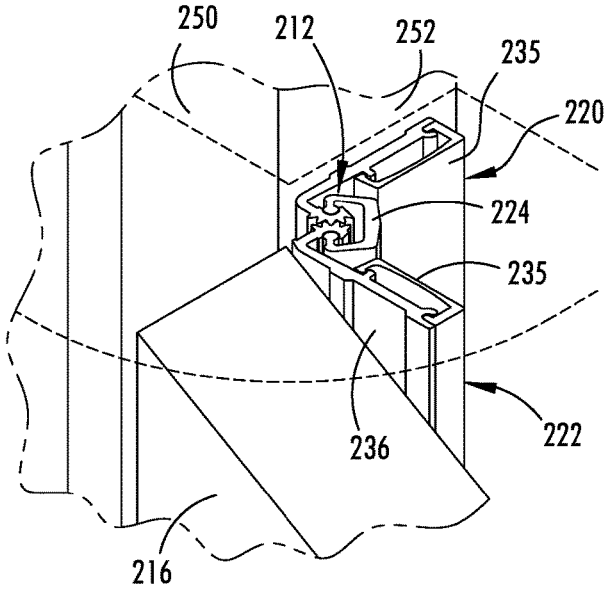
FIG. 9A is an enlarged view of the door and the door jamb shown in FIG. 9 with the radial progression hinge cap removed to expose a different geared continuous hinge from those shown in FIGS. 2A and 6A.
Figure 10:
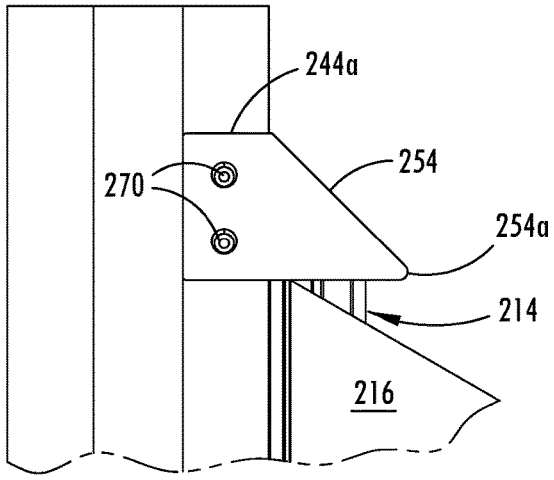
FIG. 10 is a side elevational view of the radial progression hinge cap mount at the door jamb above the door shown in FIG. 9.

Another example of a radial progression hinge cap 210 is shown in FIGS. 9-11C, where the hinge cap 210 again includes a cap body 242 that attaches to a door jamb 226 above a geared continuous hinge 214, that is shown as a full surface type hinge with both the door leaf 222 and the frame leaf 220 attached at the outer surfaces of the door and the door jamb 226, respectively. The frame leaf 220 of the hinge 214 shown in FIGS. 9A and 11A-11C is substantially a mirror image of the door leaf 222, such that the same leaf extrusions may be used and attached to both surfaces to reduce manufacturing tooling costs. When installed at the outer surface of the door 216 and the door frame 218, the frame leaf 220 and door leaf 222 of the geared continuous hinge 214 may have a fastener cover 235 that is secured vertically along an exterior side of the respective leaf to conceal the fasteners used to mount the leaf at the respective door or door frame. For example, as shown in FIG. 9A, the fastener cover 235 is secured, such as via a snap-fit connection, over the base portion 236 of the door leaf 222 that is mounted against the door 216 and secured in place with fasteners that engage the door 216.

Figure 11A:
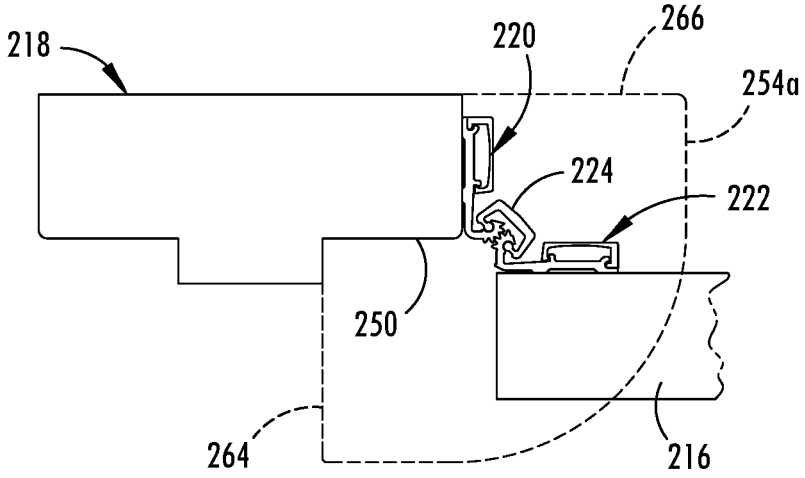
FIG. 11A is a top view of the geared continuous hinge supporting the door at the door jamb shown in FIG. 9, showing an outline of the radial progression hinge cap in dashed lines.
Figure 11B:
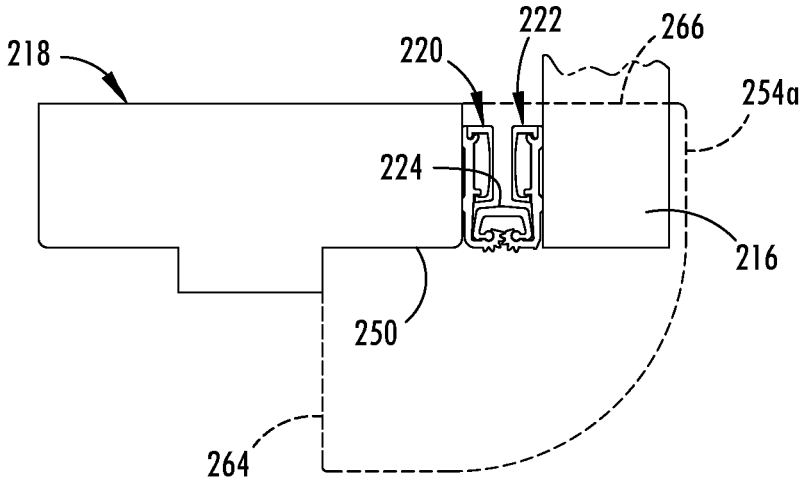
FIG. 11B is a top view of the outline of the radial progression hinge cap and the geared continuous hinge shown in FIG. 11A, showing the door at another open position.
Figure 11C:
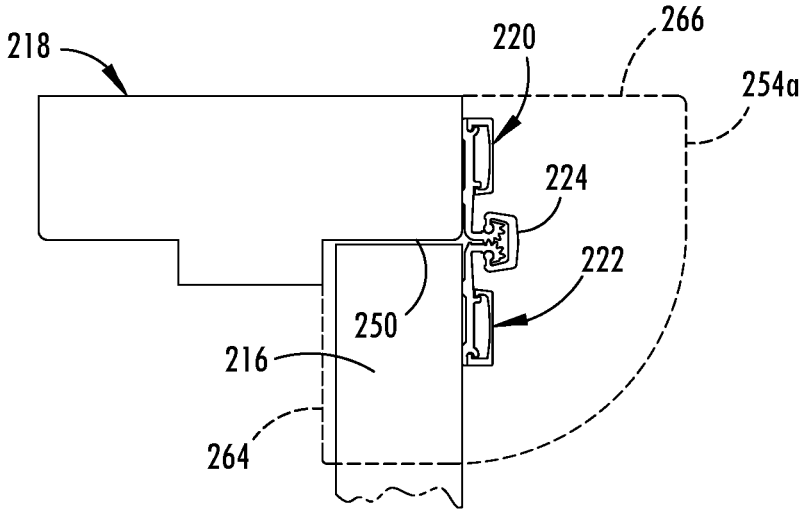
FIG. 11C is a top view of the outline of the radial progression hinge cap and the geared continuous hinge shown in FIG. 11A, showing the door at a closed position.

As shown FIGS. 9A and 11A-11C, the radial progression hinge cap 210 has an upper surface 254 that directly contacts the vertical surface of the door jamb 226 and slopes downward from the top edge 244*a* of the rear channel 244 to provide a ligature-resistant surface, generally without gaps or catch-points between the top of the cap body 242 and the door jamb 226. The upper surface 254 of the cap body 242 extends downward to and terminates at a front distal edge 254*a* of the cap body 242. As shown in FIGS. 11A-11C, the upper surface 254 of the cap body 242 spans over and conceals a top surface 212 of the geared continuous hinge 214, including the door leaf 222 and the frame leaf 220, as well as the upper corner of the door 216 as it moves between the closed position 232 (FIG. 11C) and an open positions 230 (FIGS. 8A and 8B). The coverage area of the radial progression hinge cap 210, as outlined in FIG. 9A, provides continuous coverage and concealment of the exposed upper corner of the door 216 nearest the hinge 214 and the exposed top surface 212 of the hinge 214 as moves between the various radial positions, such as between the open position 230 at 90 degrees (FIG. 11A), the open position 230 at 180 degrees (FIG. 11B), and the closed position 232 (FIG. 11C).

Other features of the radial progression hinge cap 210 and associated geared continuous hinge 214 and doorway arrangement that are similar to the radial progression hinge cap 10 and associated geared continuous hinge 14 shown in FIGS. 2-4, and thus are not described in detail again, but like reference numbers are used incremented by 200.

Referring to yet another example of a radial progression hinge cap 310 shown in FIGS. 12-15C, the hinge cap 310 includes a cap body 342 that attaches to a vertical door support 326 (i.e., door jamb) above a geared continuous hinge 314, where the vertical door support 326 and corresponding door 316 are thinner than those shown in FIGS. 1-11. Further, the door support 326 does not provide additional structure, such as a stop ridge (as shown in FIGS. 1-11) that abuts the inner edge portion of the door in the closed position. Accordingly, the vertical door support 326 and door 316 shown in FIGS. 12-15C may be of the type used in a bathroom stall or privacy enclosure of a correctional institution, such as where a door frame header may not be provided. The cap body 342 of the hinge cap 310 is secured to the door support 326 so that the cap body 342 covers the exposed top surface 312 of the geared continuous hinge 314, which is shown in FIGS. 12A and 15A-15C as a full surface type hinge, having both the door leaf 322 and the frame leaf 320 attached at the outer surfaces of the door 316 and the door support 326, respectively.

Figure 14:
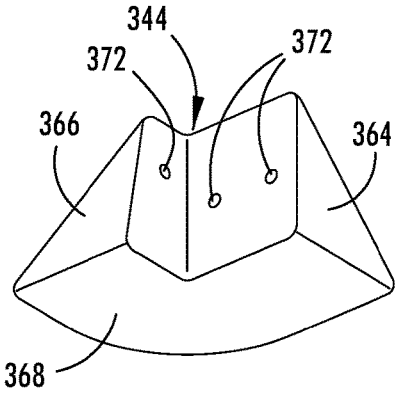
FIG. 14 is a rear perspective view of the hinge cap shown in FIG. 12.
Figure 15A:
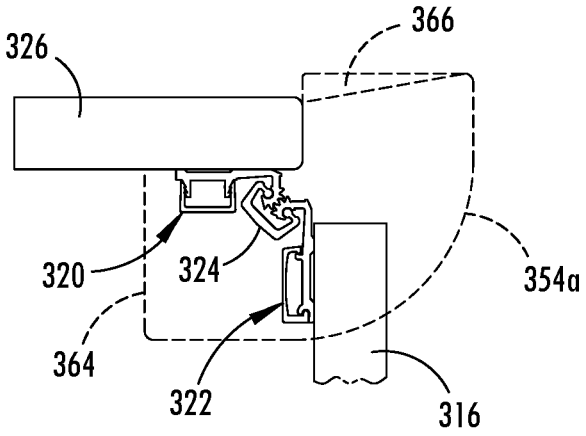
FIG. 15A is a top view of the geared continuous hinge supporting the door at the door jamb shown in FIG. 12, showing an outline of the radial progression hinge cap in dashed lines.
Figure 15B:
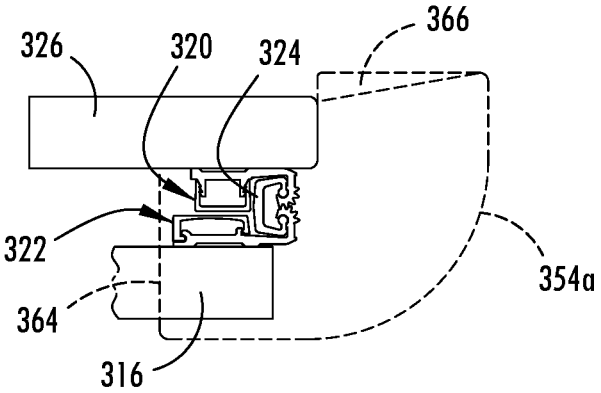
FIG. 15B is a top view of the outline of the radial progression hinge cap and the geared continuous hinge shown in FIG. 15A, showing the door at another open position.
Figure 15C:
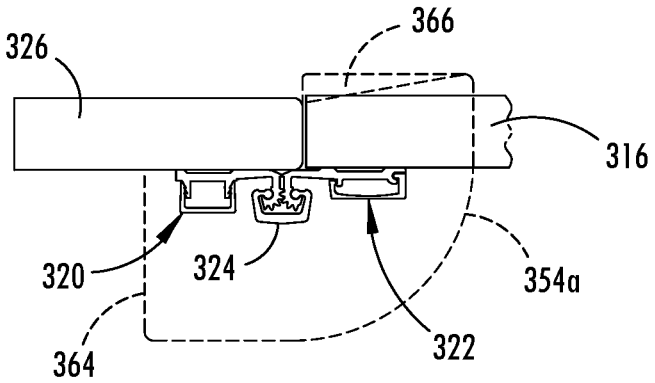
FIG. 15C is a top view of the outline of the radial progression hinge cap and the geared continuous hinge shown in FIG. 15A, showing the door at a closed position.

As shown FIGS. 12A and 15A-15C, the radial progression hinge cap 310 has an upper surface 354 that directly contacts the vertical surface of the door support 326 and slopes downward from the top edge 344*a* of the rear channel 344 (FIG. 14) to provide a ligature-resistant surface, generally without gaps or catch-points between the top of the cap body 342 and the door support 326. The upper surface 354 of the cap body 342 extends downward to and terminates at a front distal edge 354*a* of the cap body 342, where the front distal edge 354*a* protrudes a threshold distance away from the engaged portion of the door support 326. As shown in FIGS. 15A-15C, the upper surface 354 of the cap body 342 spans over and conceals a top surface 312 of the geared continuous hinge 314, including the door leaf 22 and the frame leaf 320, as well as the upper corner of the door 316 as it moves between the closed position 332 (FIG. 15C) and open positions 330 (FIGS. 15A and 15B).

As further shown in FIGS. 12 and 15A-15C, the upper surface 354 includes a first sloped portion 356, a second sloped portion 358, and a transitional sloped portion 360 that interconnects the first and second sloped portions 356, 358 with an outward protruding curvature that defines a conical shaped surface. The first and second sloped portions 356, 358 each angle downward from the top edge 344*a* of the rear channel 344 to the front distal edge 354*a*. To account for the relatively reduced thickness of the vertical door support 326 and door 316, the second sloped portion 358 at the top edge 344*a* is narrower than the first sloped portion 356. However, as shown in FIGS. 15A-15C, the second sloped portion 358 flares outward as it angles downward from the top edge 344*a* of the second planar surface 348 to the front distal edge 354*a*. With such a protruding second sloped portion 358, the lateral side surface 366 (FIG. 13) may have a downward sloping angle to position the lower edge of the cap body 342 away from the upper edge of the door 316 in the closed position (FIG. 15C).

Figure 12:
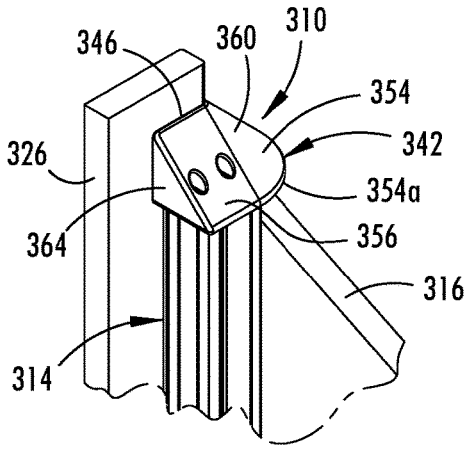
FIG. 12 is an upper perspective view of a radial progression hinge cap mounted at a door jamb above a door shown in an open position.
Figure 12A:
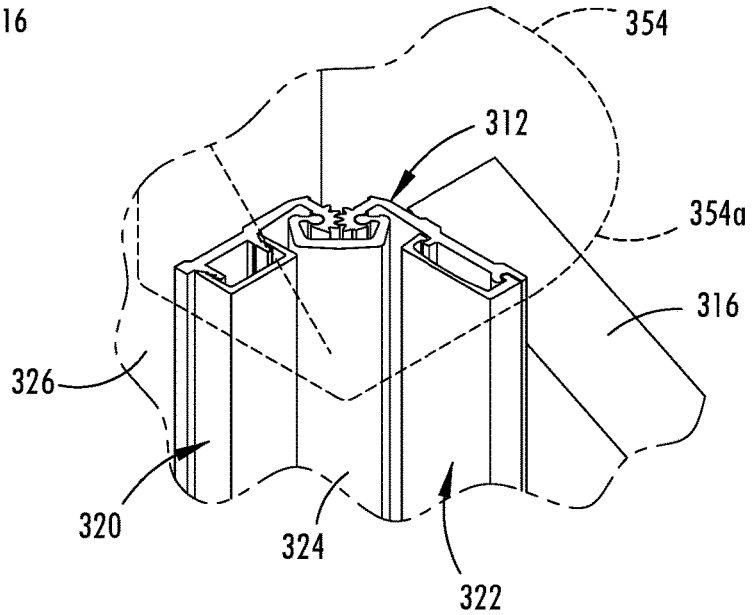
FIG. 12A is an enlarged view of the door and the door jamb shown in FIG. 12 with the radial progression hinge cap removed to expose a different geared continuous hinge from those shown in FIGS. 2A, 6A, and 9A.
Figure 13:
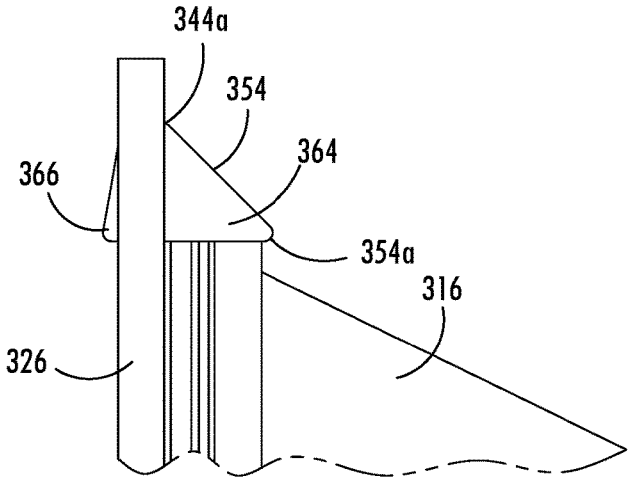
FIG. 13 is a side elevational view of the radial progression hinge cap mount at the door jamb above the door shown in FIG. 12.

Also, as shown in FIGS. 12 and 14, the cap body 342 is mounted at the door support 326 with three fasteners that extend through countersunk holes 372 in the cap body 342, which conceal the head portion, so as to prevent misuse of the fastener. The first sloped portion 356 of the upper surface 354 has two holes 372 disposed side-by-side that extend in parallel alignment with the lateral side surface 364 and pass through the rear channel 344 (FIG. 14). Also, the second sloped portion 358 of the upper surface 354 has a single hole 372 that extends in perpendicular to the others holes 372 and passes through the second planar surface 348 of the rear channel 344. The holes 372 are arranged for receiving fasteners 370 that attach the cap body 342 to the corner portion of the door support staggered manner that avoid contacting each other when the perpendicularly extending fasteners 372 engage the door support 326.

Other features of the radial progression hinge cap 310 and associated geared continuous hinge 314 and doorway arrangement that are similar to the radial progression hinge cap 10 and associated geared continuous hinge 14 shown in FIGS. 2-4, and thus are not described in detail again, but like reference numbers are used incremented by 300.

It is to be understood that the specific devices and processes illustrated in the attached drawings, and described in this specification are simply exemplary embodiments of the inventive concepts defined in the appended claims. Hence, specific values and other precise physical characteristics relating to the embodiments disclosed herein are not to be considered as limiting, unless the claims expressly state otherwise.

Changes and modifications in the specifically described embodiments may be carried out without departing from the principles of the present disclosure, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A ligature resistant hinge assembly, comprising:

a geared continuous hinge having a frame leaf in meshed engagement with a door leaf and a cover holding meshed gear sections of the frame leaf and door leaf together along a length of the geared continuous hinge, wherein the frame leaf is configured to be mounted at a door jamb and the door leaf is configured to be mounted to a door that is movable between open and closed positions about the geared continuous hinge; and a radial progression hinge cap configured to attach to the door jamb above the geared continuous hinge, wherein the radial progression hinge cap comprises:

a rear channel having a first planar surface and a second planar surface oriented perpendicular relative to each other, wherein the first planar surface is configured to be attached at an inner vertical surface of the door jamb that faces an edge portion of the door in the closed position, and wherein the second planar surface is configured to be attached at an outer vertical surface of the door jamb that is generally parallel with a planar extent of the door in the closed position; and an upper surface that slopes downward from a top edge of the first and second planar surfaces of the rear channel to a front distal edge of the radial progression hinge cap, wherein the upper surface protrudes from the rear channel a threshold distance that extends over and conceals a top surface of the geared continuous hinge and an upper corner of the door as it moves between the closed position and the open position.

2. The ligature resistant hinge assembly of claim 1, further comprising a fastener that has a head portion and a shank portion that is configured to extend through a countersunk hole in the upper surface of the radial progression hinge cap to mount the radial progression hinge cap at the door jamb, wherein the head portion of the fastener is disposed in a head section of the countersunk hole.

3. The ligature resistant hinge assembly of claim 1, wherein the upper surface of the radial progression hinge cap flares outward as it slops downward from the top edge.

4. The ligature resistant hinge assembly of claim 1, wherein the upper surface of the radial progression hinge cap comprises an outward protruding curvature that defines a conical surface.

5. The ligature resistant hinge assembly of claim 3, wherein the conical surface extends to the front distal edge, the front distal edge comprising an arcuate shape.

6. The ligature resistant hinge assembly of claim 3, wherein a narrow portion of the conical surface follows the top edge of the rear channel and a widened portion of the conical surface follows the front distal edge.

7. The ligature resistant hinge assembly of claim 1, wherein the upper surface of the radial progression hinge cap comprises a hole for receiving a fastener that attaches the radial progression hinge cap to the door jamb.

8. The ligature resistant hinge assembly of claim 1, further comprising a fastener that has a head portion and a shank portion that is configured to extend through a hole in the upper surface of the radial progression hinge cap to mount the radial progression hinge cap at the door jamb.

9. The ligature resistant hinge assembly of claim 8, wherein, with the shank portion engaged at the doorjamb, the head portion of the fastener is disposed in an enlarged section of the hole and does not protrude outward from the upper surface of the radial progression hinge cap.

10. The ligature resistant hinge assembly of claim 1, wherein the radial progression hinge cap comprises at least one of a polymeric material or a metal material.

11. The ligature resistant hinge assembly of claim 1, wherein the upper surface of the radial progression hinge cap comprises a low friction finish.

12. A ligature resistant hinge assembly comprising:

a geared continuous hinge having a frame leaf in meshed engagement with a door leaf and a cover holding meshed gear sections of the frame leaf and door leaf together along the geared continuous hinge, the frame leaf configured to be mounted at a door jamb and the door leaf configured to be mounted to a door that is movable between open and closed positions about the geared continuous hinge; and a radial progression hinge cap configured to attach to the door jamb above the geared continuous hinge, the radial progression hinge cap comprising:

a rear portion having an attachment channel that is configured to be vertically oriented and attached at a corner of the door jamb defined by an inner vertical surface that faces an edge portion of the door in the closed position and an outer vertical surface is generally parallel with a planar extent of the door in the closed position; and a front portion having an upper surface that slopes downward from a top edge of the attachment channel to a lower edge of the front portion that, when attached to the door jamb above the geared continuous hinge, extends over a top surface of the geared continuous hinge and an upper corner of the door in the open and closed positions.

13. The ligature resistant hinge assembly of claim 12, wherein the upper surface of the radial progression hinge cap flares outward as it slops downward from the top edge of the attachment channel.

14. The ligature resistant hinge assembly of claim 12, wherein the upper surface of the radial progression hinge cap comprises a conical surface.

15. The ligature resistant hinge assembly of claim 14, wherein the conical surface extends to the lower edge of the front portion, the lower edge comprising an arcuate shape.

16. The ligature resistant hinge assembly of claim 14, wherein a narrow portion of the conical surface is disposed at the top edge of the attachment channel and a widened portion of the conical surface is disposed at the lower edge of the front portion.

17. The ligature resistant hinge assembly of claim 12, wherein the lower edge of the radial progression hinge cap protrudes a threshold distance away from the attachment channel so that, when attached to the door jamb above the geared continuous hinge, the upper surface spans over and continuously conceals the top surface of the hinge and the upper corner of the door as the door moves at least 90 degrees between the open and closed positions.

18. The ligature resistant hinge assembly of claim 12, wherein the upper surface of the radial progression hinge cap comprises (i) a first sloped portion that angles downward from the top edge of the attachment channel to the lower edge of the front portion, (ii) a second sloped portion that angles downward from the top edge of the attachment channel to the lower edge of the front portion, and (iii) a third sloped portion that interconnects the first and second sloped portions to form a conical surface.

19. The ligature resistant hinge assembly of claim 12, wherein the first and second sloped portions of the upper surface comprise an equal and constant downward sloping angle, and wherein the conical surface of the third sloped portion mates flush with the first and second sloped portions.

20. A ligature resistant hinge assembly comprising:

a geared continuous hinge having a frame leaf configured to be mounted at a door frame and a door leaf configured to be mounted to a door that is movable between open and closed positions about the geared continuous hinge; and a radial progression hinge cap configured to attach to the door frame above the geared continuous hinge, the radial progression hinge cap comprising:

a rear channel having (i) a first surface configured to be attached at an inner vertical surface of the door frame that faces an edge portion of the door in the closed position and (ii) a second surface is configured to be attached at an outer vertical surface of the door frame; and an upper surface that slopes downward from a top edge of the rear channel to a front distal edge of the radial progression hinge cap, the upper surface comprising a conical shaped surface that extends to an arcuate shaped portion of the front distal edge, and the front distal edge protruding a threshold distance away from the rear channel so that the upper surface spans over and conceals a top surface of the geared continuous hinge and an upper corner of the edge portion of the door as it moves at least 90 degrees between the open and closed positions.

* * * * *